United States Patent [19]

Plunk

[11] Patent Number: 4,755,830

[45] Date of Patent: Jul. 5, 1988

[54] UNIVERSAL ANTENNA POLE MOUNTING BRACKET ASSEMBLY

[76] Inventor: Richard L. Plunk, 5335 Egbert, Houston, Tex. 77007

[21] Appl. No.: 798,408

[22] Filed: Nov. 15, 1985

[51] Int. Cl.[4] ..... H01Q 1/12

[52] U.S. Cl. ..... 343/890; 343/882; 343/880; 248/514; 248/539

[58] Field of Search ..... 343/890, 892, 880, 881, 343/882; 248/536, 539, 534, 518, 514, 277

[56] References Cited

U.S. PATENT DOCUMENTS

| | | | |
|---|---|---|---|
| 1,851,178 | 3/1932 | Hebig | 343/892 |
| 2,495,972 | 1/1950 | Johnson | 248/539 |
| 2,628,796 | 2/1953 | Krizman | 248/536 |
| 2,900,154 | 8/1959 | Schweim | 248/534 |
| 2,954,909 | 10/1960 | Miller et al. | 248/514 |
| 3,159,439 | 12/1964 | Miller | 248/277 |
| 3,208,703 | 9/1965 | Arnold et al. | 248/514 |
| 3,357,663 | 12/1967 | Ivy | 248/539 |
| 3,450,378 | 6/1969 | Cucka | 248/539 |
| 4,181,284 | 1/1980 | Seppelfrick | 248/539 |
| 4,500,064 | 2/1985 | Calabro | 248/539 |
| 4,510,502 | 4/1985 | Hoyland et al. | 343/890 |
| 4,595,165 | 6/1986 | Kingensmith et al. | 343/892 |

FOREIGN PATENT DOCUMENTS

| | | | |
|---|---|---|---|
| 0170088 | of 1901 | United Kingdom | 248/277 |

*Primary Examiner*—William A. Cuchlinski, Jr.
*Assistant Examiner*—Thomas B. Will
*Attorney, Agent, or Firm*—Dodge, Bush & Moseley

[57] ABSTRACT

In accordance with an illustrative embodiment of the present invention, an antenna pole mounting assembly for a dish antenna or the like includes an elongated base bracket, a pivot bracket, scissor arms for connecting the base and pivot brackets to one another in various offset positions, and a pole clamp ring secured to the pivot bracket in a manner that allows full rotation orientation, whereby the base bracket can be secured to a wall in other than a horizontal position with the clamp ring in the vertical.

1 Claim, 1 Drawing Sheet

UNIVERSAL ANTENNA POLE MOUNTING BRACKET ASSEMBLY

FIELD OF THE INVENTION

This invention relates generally to antenna pole support brackets, and particularly to a new and improved, adjustable bracket assembly for use in securing the support pole of a satellite antenna or the like to a house or other building structure.

BACKGROUND OF THE INVENTION

A wide variety of brackets are known for the purpose of securing an antenna support pole to the eves or walls of a house. In a typical installation, the lower end of the pole is fixed to the ground, and a bracket including a U-bolt is used to fix a central point on the pole to the eve of the house. Due to the short length of the bracket, the installer is indeed fortunate if he is able to line up one side of the bracket with a wall stud or other beam to provide a sturdy anchor point. The other side of the bracket must be anchored in thin siding that provides very little strength to the connection. This type of fixture is likely to come loose over a period of time as the siding weathers, and the antenna is subjected to wind loads which create high lateral forces at the bracket.

In this type of mounting, the U-bolt is tightened to hold the pole firmly against the bracket. However, if the U-bolt is tightened to its proper torque, it can actually put a crimp in the support pole and weaken it at its most crucial point. On the other hand, if the U-bolt is not properly tightened the pole may be able to twist back and forth in the wind and permit misdirection of the antenna. This is, of course, undesirable because the owner may have to incur the expense of a service call to have a technician realign and tighten the system.

Other problems have been encountered when attempting to install a bracket at the same angle or pitch as the roof on a house. Prior devices that have employed clamps of one type or another have the disadvantage that they may not fit properly against or around a vertical pole. An associated problem is encountered is where a lateral offset is required to mount a bracket flush against a wall surface, and have the pole clear a roof overhang. Since the amount of offset can, and often does, vary from structure to structure, prior devices have either been unsuitable, or were adjustable via weak linkage arrangements that did not provide a rugged and sturdy mount. In both of these cases the installer had to rig up a special fixture on the spot, or was required to carry a large inventory or special parts which might or might not be used on any given installation job.

An object of the present invention is to provide a new and improved antenna pole mounting bracket that obviates most all of the foregoing problems.

Another object of the present invention is to provide a new and improved pole mounting bracket assembly having a base that allows attachment to at least two structural beams of a house.

Another object of the present invention is to provide a new and improved bracket assembly of the type described that has a clamping element which can accommodate a plurality of different standard pole sizes, while centering the pole in a rigid position.

Another object of the present invention is to provide a new and improved antenna pole bracket that can be adjusted to accommodate various offsets of the pole axis with respect to the base of the bracket which is attached to a structural wall.

Yet another object of the present invention is to provide a new and improved antenna pole mount where the base bracket can be attached at different angles with respect to horizontal, while clamping the support pole in the vertical.

SUMMARY OF THE INVENTION

These and other objects are attained in accordance with the present invention through the provision of a mounting assembly comprising a base member, preferably made of angle-iron, having a first plurality of bolt holes distributed along one side thereof on different center-to-center spacings to accommodate several standard structural beam spacings, and a second plurality of bolt holes distributed along its other side and arranged symmetrically to either side of a central line. A pivot bracket, also preferably made of a short length of angle iron, has a pair of spaced bolt holes on one side thereof, and a single bolt hole located centrally on the other side thereof. A pair of arms can be connected in a crossed, or scissor, manner between the base bracket and the pivot bracket by bolts that extend through the pair of holes in the pivot bracket, and a selected one of the plurality of pairs of bolt holes in the base bracket. The selection of a particular pair of holes in the base bracket determines the angular relationship of the crossed arms, which determines the amount of offset distance between the base bracket and the pivot bracket.

A clamp ring has a threaded stud welded to one side thereof, which is passed through the single bolt hole in the pivot bracket flange. A nut that is threaded into the stud can be tightened to secure the clamp ring to the pivot bracket in any orientation through a full 360°. The clamp ring is provided with three set screws on 120° spacings which can be selectively tightened against the outer surfaces of a tubular support pole, the clamp ring being sized and arranged to accommodate a plurality of different diameter sizes of support poles that extend concentrically therethrough.

The bolt hole spacings of the base permit bracket attachment to at least two stuctural beams in a house wall, while the arms can be set to accommodate different offsets of the clamp ring with respect to the base. The mounting nut can be tightened with the clamp ring in the vertical, regardless of the orientation of the base bracket with respect to horizontal. Since the clamp ring can accommodate various sizes of tubular support poles, it will be recognized that the present invention provides a rugged and universal mounting assembly that achieves all of the foregoing objectives.

BRIEF DESCRIPTION OF THE DRAWINGS

The present invention has other objects, features and advantages which will become more clearly apparent in connection with the following detailed description of a preferred embodiment, taken in conjunction with the appended drawings in which.

DETAILED DESCRIPTION OF A PREFERRED EMBODIMENT

Figure 1:
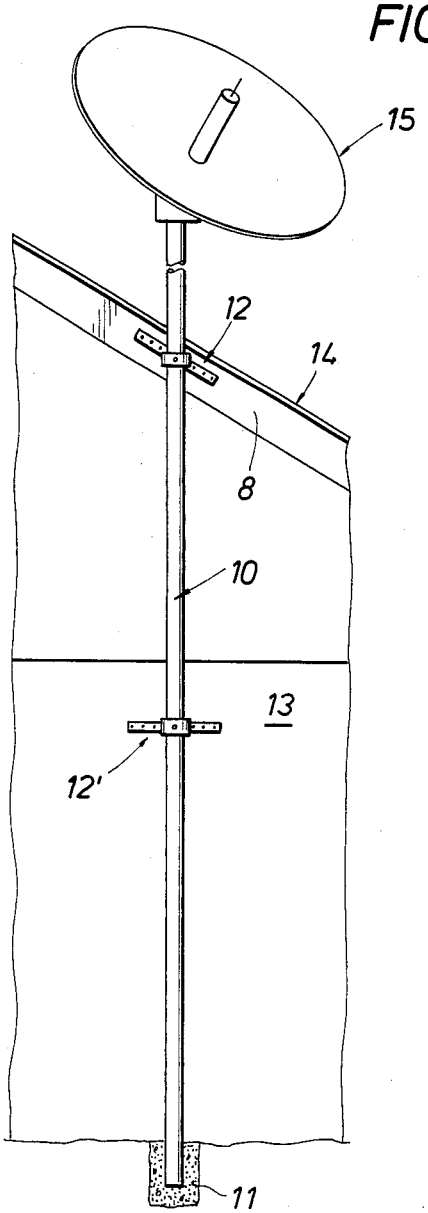
FIG. 1 is a schematic elevational view of an antenna support pole attached to a house through use of the present invention.

Referring initially to FIG. 1, there is shown schematically an antenna support pole 10 having its lower end fixed to the ground in a suitable manner, for example by being set in a concrete footing 11. A mounting assembly 12 constructed in accordance with the present invention is attached to eves 8 of a house 14, and clamps the pole 10 in the vertical position. An additional mounting assembly 12', identical in construction to assembly 12, may be used to provide further support of the pole 10 to the side 13 of the house 14. An antenna 15, such as a satellite dish or a television signal receiver, is secured to the upper end of the pole by a suitable mechanism that fixes the same so that it points in a selected direction, or that enables the antenna to be redirected on command by an appropriate control signal. The pole 10 may be guyed down in a conventional manner, if necessary or desirable.

Figure 2:
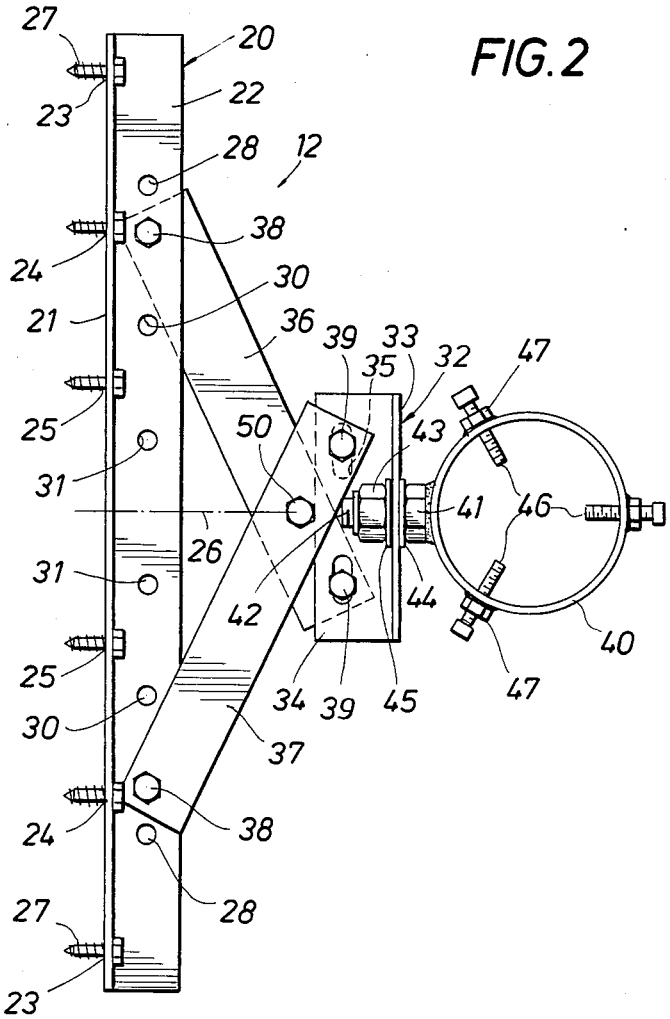
FIG. 2 is top plan view of a pole mount assembly in accordance with this invention.

The mounting assembly 12 is shown in top plan view in FIG. 2. The assembly includes a base bracket 20 made in angle iron having an inner vertical side 21 and an outwardly extending side 22. As illustrated, the inner side 21 can have three pairs of bolt holes 23–25 located at set distances to either side of central transverse axis 26. The pairs of holes are arranged on center distance that correspond with various standard centers of the main structural members of a wall, such as studs. For example, the outer pair 23 can be located on 24 inch centers, and the next pair 24 on 18 inch centers. The inner pair 25 can be located on 12 inch centers. In the event, it will be appreciated that the installer will be able to secure the base bracket 20 to the wall 13 by lag screws 27 or bolts to provide a very rigid mount since the screws can be anchored in an adjacent pair of studs.

Another plurality of pairs of bolt holes 28–31 (bolt hole 29 not shown) are formed in the horizontal side 22 of the bracket 20, with each pair being located at complementary distances to the sides of the axis 26. A relatively shorter pivot bracket 32 having an upper side 33 and an inwardly extending side 34 has another pair of bolt holes 35 formed therein. A pair of arms 36, 37 having bolt holes in their respective oppposite ends are secured by bolts 38, 39 to the base bracket 20 and to the pivot bracket 32 in a scissor-like, or crossed, configuration. Bolts 38 are received through holes in the arms 36, 37 and through holes 29 (not shown) of bracket 20. This structural arrangement permits the pivot bracket 32 to be connected in one of four offset positions with respect to the base bracket 20, depending upon the selection of the pair of the bolt holes 28–31 to which the inner ends of the arms are connected. Of course when the arms are bolted to the pair of holes 30, the amount of offset is the greatest; when the arms are bolted to the outermost pair 28 of holes, the offset is the least amount. A bolt 50 through arms 36 and 37 secured by a nut (not shown) provides rigidity to the scissor configuration.

The upper side 33 of the pivot bracket 32 has a bolt hole that is aligned in the vertical plane of the axis 26. An elongated tubular clamp member or ring 40 has the head 41 of a stud 42 welded to one side thereof, with the stud extending through the pivot bracket hole and being secured by a locking-type nut 43. Washers 44, 45 can be positioned as shown. The clamp ring 40 can be pivoted about the axis of the stud 42 through a full 360° of rotation, and can be fixed in any orientation with respect to the pivot bracket 32 and the base bracket 20 by tightening the nut 43.

Figure 3:
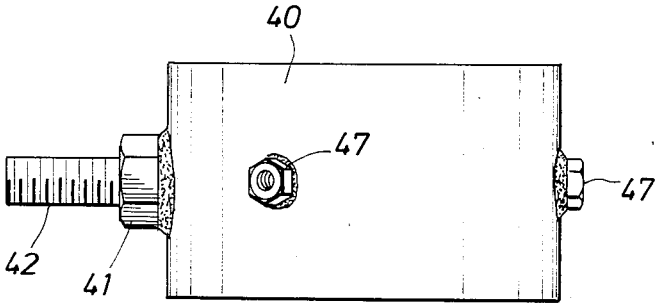
FIG. 3 is a side view of the mounting ring.

As shown in FIGS. 2 and 3, the clamp ring 40 has three set screws 46 located on radial lines at 120° from on another. Each set screw 46 extends through a nut 47 welded to the outer side of the ring 40, so that each screw can be independently advanced inwardly. The inner diameter of the clamp ring 40 is sized such that it can be positioned around any one of several standard diameter support poles.

Of course, although the clamp member 40 has been shown as a ring, it could be constructed to have a triangular or a square cross-section (with 3 set screws being used in the last-mentioned example).

OPERATION

To attach the mounting bracket 12 to the eave of a house, the amount of offset that is needed for the pole 10 to clear the roof is first measured, and the arms 36, 37 attached to the base member 20 as previously described. The set screws 46 are backed out, and the clamp ring 40 is slipped over the end of the pole 10, which is then raised to the vertical. The base bracket 20 is located as far upward on the wall 13 as possible, and lag screws are used to attach the bracket to a pair of adjacent studs in the house wall. Then the set screws 46 are tightened against the pole 10 to fix it in the center of the ring 40.

In the event it is desired to position base bracket 20 in other than a horizontal position, alignment is automatically accomplished by inserting the stud 42 in the pivot bracket 33. Once the base bracket 20 is secured, the nut 43 is tightened.

The present invention has particular utility in connection with the mounting of satellite dish antennas, which are becoming more and more common in usage. This type of antenna can be relatively heavy compared to a television antenna, and requires a more sturdy mounting assembly. The present invention accommodates a wide variety of pole sizes, and can be set in one of four of the most common offset distances that are encountered by installers. The term "offset" in the context use herein means the lateral distance between the support pole and the building to which the pole is attached. If not required for a particular installation, the scissor arms 36, 37 can be omitted, and the pivot bracket 32 attached directly to the inner pair of holes 31 in the base bracket 20.

The elongated base bracket 20 having a plurality of pairs of mounting holes, makes it is relatively easy for the installer to be able to align two spaced apart lag screws with adjacent studs, or other structural beams, within the house wall. Older as well as newer standard studs centers can be accommodated. Of course the base member 20 need not always be mounted horizontal, so long as there remains enough separation of the vertical planes in which the lag screws are located that a rugged base is provided against movement of the clamp ring 40 in a direction perpendicular to the aixs 26.

The use of set screws rather than a U-bolt clamp prevents weakwning of the support pole by crimping at its mosrt crucial point. Upon tightening, the pole is forced toward the center, and against two opposing set screws to lock the pole against rotation with practically no adverse effects to the wall of a house at the same angle at that defined by the pitch of the roof, yet with the pole straight up and down due to the unique pivoting feature of the present invention.

If even greater offset is required, the bolt 42 can be made longer than shown in FIGS. 2 and 3, and another nut 43 positioned between the head 41 and the pivot bracket 32. With additional offset distance, the nuts are tightened against the opposite sides of the upper portion 33 of the bracket 32.

It thus will be recognized that a new and improved antenna pole mounting assembly has been provided that is highly versatile in application, that has great structural strength, and is of relatively low cost when considering its various unique features. Since certain changes or modifications may be made in the disclosed embodiment without departing from the inventive concepts involved, it is the aim of the appended claims to cover all such changes and modifications falling within the true spirit and scope of the present invention.

What is claimed is:

1. A mounting assembly for an upright antenna pole, comprising: an elongated base bracket having a plurality of pairs of spaced-apart holes; means to permit attaching said base bracket to a wall; a pivot bracket; arm means for attaching said pivot bracket to said base bracket, said arm means including a pair of arms disposed in a crossed configuration, each of said arms having its outer end secured to said pivot bracket and its inner end secured to a selected one of said spaced-apart holes, said arms being pivotally attached to one another at the point where said arms cross one another; means for securing the outer end of each of said arms to said pivot bracket comprising an elongated slot in said pivot bracket, a hole in the outer end of each of said arm, and fastener means extending through said hole and said slot, whereby the inner ends of said arms can be secured to a respective pair of said spaced-apart holes in said base bracket while maintaining said pivot bracket generally parallel to said base bracket; and clamp means pivotally secured at a right angle to said pivot bracket to enable said clamp means to be positioned in a selected rotational orientation with respect to said pivot bracket.

* * * * *